United States Patent [19]

Schuierer

[11] 4,163,298

[45] Aug. 7, 1979

[54] DYEING OF PILE FABRICS

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 940,909

[22] Filed: Sep. 11, 1978

[30] Foreign Application Priority Data

Oct. 21, 1977 [DE] Fed. Rep. of Germany ..... 2747347

[51] Int. Cl.[2] ..... D06B 1/06; D06B 23/00

[52] U.S. Cl. ..... 8/151; 68/13 R; 68/205 R; 68/212; 242/55; 242/75.5

[58] Field of Search ..... 8/147, 151, 154; 68/13 R, 147, 180, 200, 202, 205 R, 212; 242/55, 75.5

[56] References Cited

U.S. PATENT DOCUMENTS 2,199,594 5/1940 Kent ..... 8/151 X

FOREIGN PATENT DOCUMENTS 2405314 8/1975 Fed. Rep. of Germany ..... 68/205 R

*Primary Examiner*—Philip R. Coe

*Attorney, Agent, or Firm*—Learman & McCulloch

[57] ABSTRACT

Methods of and apparatus for cold dyeing pile fabrics, particularly carpets, wherein dye liquor is first applied to the pile side of the fabric in an amount between 150% and 300% of the material weight, the dye impregnated fabric then being coiled, under tension, into a roll and the roll allowed to stand, all at room temperature. The magnitude of the tensile force applied to the fabric is greater than about 90% of that required to cause dye liquor to emerge from the roll, but is not more than that which enables 5%, at the most, of the liquor to emerge from the roll.

14 Claims, 2 Drawing Figures

DYEING OF PILE FABRICS

BACKGROUND OF THE INVENTION

In a known cold dyeing method the dye liquor conventionally is applied to the pile side of a continuously conveyed fabric web, the aim being to obtain a good coloring through the fabric pile side (down to the pile backing or base) with a minimum of liquor. After the application of the dye liquor the pile fabric is loosely coiled to form a roll (or lap) to avoid damage to the pile side, and the roll is then left to stand, generally cold, to improve the distribution of the dye liquor. However, the loose rolls result in only relatively little pile fabric being contained therein because with larger diameters they are very unstable and cumbersome; moreover, for a good dyeing of the pile side (down to the pile base) a disproportionately large amount of dye liquor is frequently necessary.

SUMMARY OF THE INVENTION

The invention has for its principal objective the provision of a method and apparatus for cold dyeing carpet pile distinguished by economy and by a roll which, when compared with conventional rolls, can contain a larger amount of fabric.

This objective is attained according to the invention in that the pile fabric is coiled with a coiling tension of such magnitude that, during the coiling about 5%, at the most, of the liquor quantity applied emerges, but which is greater than about 90% of the coiling tension at which the liquor begins to emerge.

GENERAL DESCRIPTION OF THE INVENTION

The present invention relies firstly upon the recognition that in the cold dyeing or cold dwell dyeing method practically no swelling of the fibres of the fabric pile takes place. As a result, after application of the liquor the pile fabric may be coiled relatively firmly without the pile being flattened, as generally feared hitherto. In this manner a stable roll (lap) of a relatively large amount of fabric can be made; such a stable roll then may be easily handled during the further treatment of the pile fabric.

It has been found that the pile of such a firm coil is not damaged in any way; in the subsequent washing of the pile fabric, usually necessary in any case after being left for some time or on treatment with a mechanical brush beating means, the compressed pile is easily raised again without difficulty. It has further been found in tests of the principles on which the invention is based that there is a relationship between the liquor application and roll firmness or hardness. For example, the relatively tight coiling of the dyed pile fabric renders the liquor applied mobile and ensures a dyeing of the pile side down to the base of the pile. Thus, it is possible to obtain satisfactory dyeing of the pile fabric (in particular of the pile side thereof) with a relatively small amount of liquor.

According to the invention, for a predetermined minimised amount of dye liquor the pile fabric is coiled with a coiling tension such that the roll firmness is just below the limit value at which liquor is expelled from the roll.

This coiling can be advantageously facilitated in that during the coiling a mechanical force is exerted on the roll being formed, such force being so dimensioned that the coiling is just below the limit loading at which the dye liquor begins to emerge.

For good dyeing of the stable roll thus made it is furthermore advantageous to allow the finished roll to stand in the cold state at a speed of rotation of at the most 5 rpm.

An apparatus for carrying out the method includes a dye application means and a winding roller driven with regulatable speed, and is characterized according to the invention in that, above the winding roller, force applying means is provided for guiding the fabric onto the winding roller, the applied force of which is adjustable with respect to the roll to be formed.

According to an advantageous development of this apparatus fluid-actuated cylinder-piston units are provided for the adjustability of the force applied by the force application means which preferably comprises a roller. With the aid of these units the force applying roller may be moved toward and away from the winding roller as desired, enabling a fine adjustment of the coiling tension.

DESCRIPTION OF THE DRAWINGS

The invention will be explained hereinafter with reference to two embodiments illustrated in the drawings, wherein.

DETAILED DESCRIPTION OF THE INVENTION

Figure 1:
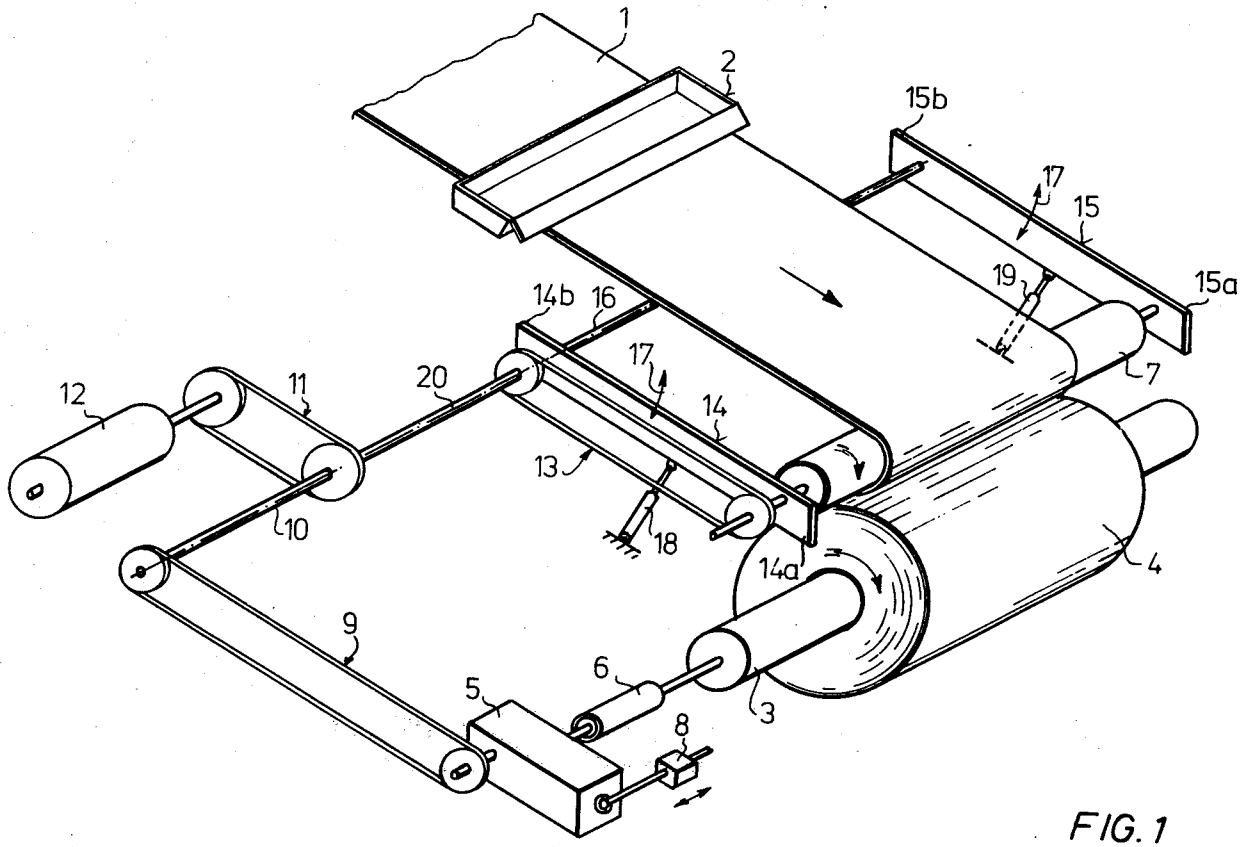
FIG. 1 is a schematic perspective view of a first embodiment of the invention.

In the cold dyeing apparatus illustrated in FIG. 1 the pile fabric 1, e.g., a carpet, is passed with its pile side upwards beneath a suitable dye application means 2 (e.g., a dye applicator with overflow) in continuous manner, the desired dye liquor quantity (between 150% and 300% of the material weight) being applied to the pile side of the fabric 1. The web-like pile fabric 1 thus impregnated with liquor is subsequently wound on a winding roller or mandrel 3 to a firm and stable annular roll 4 in which the pile fabric 1 is coiled with its pile side inwards. The desired coiling tension can be obtained, on the one hand, by a known winding roller transmission 5 of regulatable speed of rotation coupled to the winding mandrel 3 via a coupling 6 and, on the other hand, by a force applying roller 7 which spans the width of the web and which can be adjusted toward and away from the roll being formed.

The controllable winding roller transmission 5 may be a conventional winding roller transmission by means of which a selected coiling tension over the winding roller is kept constant even with a continuously varying roll diameter; the coiling tension is regulated with the aid of a shiftable weight 8. In the embodiment illustrated the winding roller transmission 5 is driven by a belt drive 9 from a drive shaft 10 which in turn is driven with the aid of a belt drive 11 by a drive motor 12. As is clearly apparent the drive shaft 10 also drives the roller 7 with the aid of a further belt drive 13, with constant speed.

To enable the force applied on the roll 4 by the roller 7, to be adjusted, such roller is mounted with its two ends at corresponding ends **14*a* and 15*a* of pivot arms 14 and 15 respectively, which can be pivoted at their other ends 14***b* and 15*b*, respectively, about a common pivot axis 16 and in the directions of the double arrow 17 so that the roller 7 may be raised from the roll to be formed or pressed thereon. To effect adjustment of the force applied by the roller 7, i.e., to effect the pivot motion of the arms 14, 15, fluid-actuated cylinder-piston units 18, 19, preferably pneumatic cylinders, are associated with such arms.

As is clearly apparent from FIG. 1 the drive shaft 10 and the pivot axis 16 have a common geometrical centre axis 20 which has the advantage that the belt drive 13 for driving the roller 7 is not stressed in any way when the position of the roller changed.

In the cold dyeing method according to the invention the pile fabric 1 is impregnated with dye liquor and then coiled with the aid of the winding mandrel 3 driven in the desired direction by the transmission 5. The roller 7 bears against the roll being formed with a suitable force. The coiling tension is adjusted, (by means of the transmission 5 and the roller 7) to such magnitude that the coiling is effected just below the limit load at which the dye liquor begins to emerge from the roll 4. This ensures that the pile fabric 1 is dyed right through to the pile base or backing.

In practice, for example, a predetermined coiling tension may be set via the winding roller transmission 5, and a fine adjustment of the coiling tension occurring at the roll 4 is obtained by mechanical force applied by the roller 7 via the cylinder-piston units 18, 19. When making the roll 4 it should also be ensured that for practical reasons the outer diameter of the finished roll 4 is at the most about three times as large as its internal diameter. A relatively firm and stable roll 4 made in this manner may then be left in the cold state at a speed of rotation of 5 rpm at the most before the pile fabric is subjected to further conventional processing, thereby ensuring complete dyeing.

Figure 2:
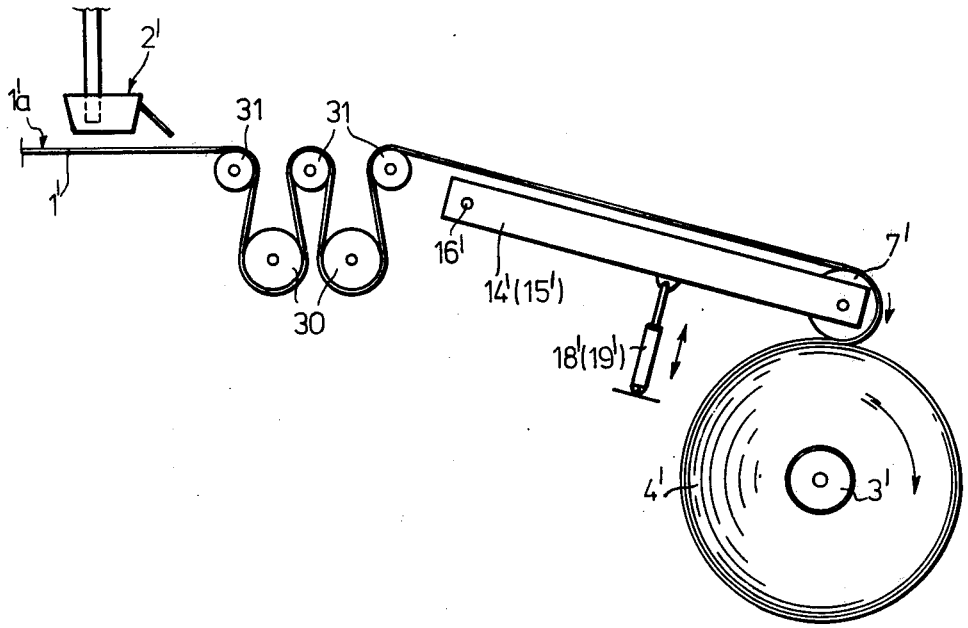
FIG. 2 is a schematic side view of a second dyeing apparatus according to the invention in which the pile fabric impregnated with the liquor is passed over structured rollers prior to coiling.

Whereas in the dyeing method and with the dyeing apparatus according to FIG. 1 the pile fabric is coiled immediately after application of the liquor, FIG. 2 shows a somewhat modified embodiment of the invention. In this case the pile side of the fabric, impregnated with liquor, is moved over a structured surface prior to coiling. This step has the advantage of removing any air inclusions which might have formed on application of the dye liquor to the pile side. That is, the dye liquor, is massaged into the pile of the fabric before the latter is coiled. In this manner, even with pile fabrics which are difficult to impregnate (e.g., terry cloth) a completely uniform penetration of the fabric with dye is ensured.

An embodiment of the apparatus according to the invention suitable for carrying out this latter procedure is shown greatly simplified in FIG. 2, those apparatus parts corresponding to the parts of FIG. 1 being provided for simplicity with the same reference numeral with an apostrophe so that a further description of these parts of the apparatus is superfluous.

In this embodiment of the invention the pile fabric web 1' to be cold dyed is led with its pile side 1'*a* upwards beneath the liquor application means 2' in continuous manner. The significant difference between the apparatus of FIG. 2 and the apparatus illustrated in FIG. 1 is that upstream from the force applying roller 7' a structured surface is provided which is adapted to be brought into contact with the pile side 1'*a* of the pile fabric 1' and which in the embodiment illustrated is formed by a plurality of napping or brush rollers 30 arranged in series. To ensure that the fabric pile side 1'*a* has the maximum possible contact area with the structured rollers 30 the fabric 1' is conducted before and after the structured rollers 30 over correspondingly disposed guide rollers 31 which are in contact with the base or backing of the pile fabric 1'.

After passing the structured rollers 30 the pile fabric 1' is then coiled in the same manner as described in detail with reference to FIG. 1 to form a tight and stable roll 4'.

Finally, the method according to the invention will be explained with reference to a practical example:

A tufted carpet of 5 m width has poured thereover with the aid of the dye application means 200% dye liquor (with respect to the weight of the material), is subsequently led with its pile side over a plurality of structured rollers (massage rollers), and thereafter conducted over the force applying roller to the winding roller. The winding roller transmission is set, by means of its shift weight, so a very tight roll results. By means of the cylinder-piston unit of the pivot arms the force applied by the roller 7 is increased until liquid begins to accummulate in the nip between the application roller and the roll being formed on the winding mandrel. The force of the roller 7 is then slightly reduced so that the operation is carried out just below the limit at which the liquid, i.e., dye liquor, begins to emerge. As soon as the coiling tension changes due to the resiliency of the fabric a correction is made by adjusting the force of the application roller and/or changing the speed thereof. When a roll has been completed it is covered with a plastic foil and left rotating.

I claim:

1. In a method of cold dyeing carpet pile fabric wherein dye liquor is applied to the pile side of the fabric in an amount between 150% and 300% of the fabric weight, followed by coiling the fabric into a roll, the improvement comprising coiling the fabric under tension which is greater than about 90% of the coiling tension at which such liquor begins to emerge from the roll and which limits the quantity of such liquor emerging from the roll to not more than 5% of the quantity of liquor applied.

2. The method according to claim 1 including applying a mechanical force on the roll being formed of such magnitude as to be just below the loading at which said liquor begins to emerge from said roll.

3. The method according to claim 1 wherein the fabric is coiled with its pile side inwards of said roll.

4. The method according to claim 1 including massaging said fabric between the application of said liquor and the coiling of said fabric.

5. The method according to claim 1 including terminating the coiling of said fabric when said roll has an external diameter about three times its internal diameter.

6. The method according to claim 1 including allowing said roll when finished to stand in a cold state.

7. The method according to claim 1 including rotating the roll when at a speed not exceeding about 5 rpm following termination of the coiling.

8. In apparatus for dyeing a web of carpet pile fabric having means for applying to the pile side of said fabric dye liquor in an amount between about 150% and 300% of the weight of said fabric, a mandrel about which said web may be coiled, and means for driving said mandrel to coil said web under tensile force into a roll with the pile side of said fabric inwards, the improvement comprising means for adjusting the tensile force applied on the roll to a magnitude greater than 90% of that required to cause said liquor to emerge from said roll but which precludes more than about 5% of said liquor emerging from said roll.

9. Apparatus according to claim 8 wherein said force applying means comprises an adjustable speed transmission interposed between said driving means and said mandrel.

10. Apparatus according to claim 8 wherein said force applying means comprises a roller of such length as to span the width of said web, means mounting said roller for movements into and out of engagement with the roll being formed, and means for adjusting the position of said roller relative to said roll that said roller exerts a force on said roll.

11. Apparatus according to claim 10 wherein said mounting means comprises a pair of arms supporting said roller at corresponding ends and being pivoted at their opposite ends.

12. Apparatus according to claim 11 wherein the means for adjusting the position of said roller comprises extensible and retractable fluid pressure means connected to said arms.

13. Apparatus according to claim 8 including structured surface means interposed between said dye liquor applying means and said mandrel and engageable with the pile side of said fabric.

14. Apparatus according to claim 13 wherein said structured surface means comprises at least one roller.

* * * * *